United States Patent [19]

Lege

[11] Patent Number: 4,743,388

[45] Date of Patent: May 10, 1988

[54] COMPLEX AMIDE CARBOXYLATE LUBRICANT RUST INHIBITOR ADDITIVE FOR METAL WORKING FLUIDS

[75] Inventor: Curtis S. Lege, Chalfont, Pa.

[73] Assignee: Westvaco Corporation, New York, N.Y.

[21] Appl. No.: 887,872

[22] Filed: Jul. 21, 1986

[51] Int. Cl.[4] ..... C10M 173/00; C10M 133/16

[52] U.S. Cl. ..... 252/51.5 A; 252/34; 252/38; 252/49.3; 252/49.5; 260/404.5

[58] Field of Search ..... 252/515 A, 49.3; 260/404.5 PA

[56] References Cited

U.S. PATENT DOCUMENTS

| | | | |
|---|---|---|---|
| 3,084,058 | 4/1963 | Hemwall | 260/404.5 PA |
| 3,216,936 | 11/1965 | LeSuer | 260/404.5 PA |
| 3,338,831 | 8/1967 | Elliot et al. | 260/404.5 PA |
| 3,374,174 | 3/1968 | LeSuer | 252/51.5 A |
| 3,448,048 | 6/1969 | LeSuer | 252/51.5 A |
| 3,483,237 | 12/1969 | Peerman et al. | 260/404.5 PA |
| 3,652,469 | 3/1972 | Glaser et al. | 260/404.5 PA |
| 3,801,609 | 4/1974 | Magne et al. | 252/46.7 |
| 3,864,368 | 2/1975 | Hartle | 260/404.5 PA |
| 3,884,947 | 5/1975 | Badin et al. | 252/51.5 A X |
| 3,896,038 | 7/1975 | Hartle | 252/51.5 A |
| 3,956,350 | 5/1976 | Pusch et al. | 260/404.5 PA |
| 4,072,641 | 2/1978 | Loeb | 260/404.5 PA |
| 4,230,588 | 11/1980 | Bonazza et al. | 260/404.5 PA |
| 4,239,635 | 12/1980 | Reider | 252/33.6 |
| 4,247,426 | 1/1981 | Hinze et al. | 260/404.5 PA |
| 4,344,861 | 8/1982 | Levy | 252/51.5 A |
| 4,537,694 | 8/1985 | Horodysky | 252/515 A |

*Primary Examiner*—William R. Dixon, Jr.
*Assistant Examiner*—Ellen McAvoy
*Attorney, Agent, or Firm*—Terry B. McDaniel; Richard L. Schmalz

[57] ABSTRACT

An additive with good anti-corrosion and lubrication properties is disclosed for use in aqueous metal working fluids. The additive comprises a fatty acid substituted, carboxylated bis-amidoamine.

59 Claims, No Drawings

COMPLEX AMIDE CARBOXYLATE LUBRICANT RUST INHIBITOR ADDITIVE FOR METAL WORKING FLUIDS

BACKGROUND OF THE INVENTION

A. Field of the Invention

The present invention relates to compositions for improving lubrication and inhibiting corrosion in synthetic and semi-synthetic metalworking fluids. Most metal working fluids used today are water based and require the use of additives to yield the desired properties. In the present invention carboxylated amine fatty acid condensates have been found to demonstrate excellent lubrication and rust inhibition properties, with only moderate foaming. As additives, these novel compositions have been used with metalworking fluids and found to be effective lubricants and rust inhibitors with the potential to reduce metalworking costs by approximately one-half.

B. Description of the Prior Art

Two essential properties to an effective metalworking fluid are that it inhibits corrosion and provides adequate lubrication. These properties, however, are not inherently coexistent and are achieved by the use of special additives. Unfortunately, some additives are effective for only one of these purposes or cause excessive foaming.

For example, U.S. Pat. Nos. 4,239,635 (and Re. 30,885) to Rieder describes metal working compositions comprising a carboxylic acid group terminated polyoxyalkylene diamide, and the alkali metal, ammonium and organic amine salts of such diamides. Structurally, the compositions of Rieder can be distinguished from the present inventive composition by, among other points, the absence of a central amine group. As demonstrated in Table I, which follows, the composition of Rieder possesses adequate lubricating properties but does not have comparable rust inhibition characteristics when compared to the compositions of the present invention.

U.S. Pat. No. 4,344,861 to Levy discloses a method of inhibiting the corrosion of metals in contact with petroleum and petroleum fractions using bis-amides. The bis-amides are formed by reacting one or more polyamines with a dimer acid or with a dicarboxylic acid having from 2–12 carbon atoms. Although no specific dimer acids are listed, those produced by dimerizing fatty acids of 18 carbon atoms are stated to be of particular interest. Unlike the present invention, the composition disclosed in Levy is not shown to have any efficacious lubricating properties.

U.S. Pat. No. 3,801,609 to Magne discloses a lubricant comprising N,N-disubstitued fatty acid amines. Not only are there obvious structural differences between the present invention and the amines of Magne, the latter do not appear to possess effective corrosion inhibiting characteristics.

Finally, in an article by Ward, Jr. et al entitled "Industrial Utilization of $C_{21}$, Dicarboxylic Acid" appearing at pages 219–224 in the July 1975 issue of *Journal of the American Oil Chemists' Society,* (Vol. 52), there are disclosed certain 21 carbon dicarboxylic acids having a plurality of industrial applications, including lubrication and corrosion inhibition. The article, however, does not disclose the carboxylated bis-amidoamines of the present invention.

SUMMARY AND OBJECTS OF THE INVENTION

In view of the foregoing limitations and shortcomings of the prior art compositions, as well as other disadvantages not specifically mentioned above, it should be apparent that there still exists a need in the art for an effective lubricating and anti-corrosion composition for the metalworking industry.

It is therefore a primary object of the present invention to provide fatty acid condensates which demonstrate excellent corrosion inhibition and lubrication properties with moderate foaming.

Another object of the present invention is to provide metalworking fluid additives which lower the cost of metal-working operations.

Yet another object of the present invention is to provide improved corrosion inhibition, lubricating compositions prepared by carboxylating a fatty acid substituted bis-amidoamine.

Still another object of the present invention is to provide a metalworking method using the new and improved complex amide carboxylate fluid of the present invention.

Other objects and advantages of the present invention will become apparent from the detailed description which follows.

Briefly stated, the composition of the present invention comprises an aqueous solution containing an effective amount of a fatty acid substituted, carboxylated bis-amidoamine and appropriate salts thereof.

The preferred fatty acids of the present invention are oleic, linoleic, stearic, palmitic and palmitoleic acids. Although any combination of these acids would be effective, it is preferred that they comprise 40–60 wt.% oleic acid, 40–50 wt.% linoleic acid, 0.5–3.0 wt.% stearic acid, 0.1–2.0 wt.% palmitic acid, and 0.1–2.0 wt.% palmitoleic acid. In the most preferred embodiment, the fatty acid comprises 50.5 wt.% oleic acid, 46.5 wt.% linoleic acid, 1.5 wt.% stearic acid, 1 wt% palmitic acid and 0.5 wt.% palmitoleic acid. Nevertheless, in certain circumstances which will be discussed below, it may be necessary to substitute a 21 carbon dicarboxylic acid. The bis-amidoamine is a derivative of either diethylene triamine or dipropylene triamine. Carboxylation is accomplished by the addition of maleic anhydride, acrylic acid, phthalic anhydride or methyl maleic anhydride. The neutralizing agent may be either organic or inorganic, triethanolamine being preferred. However, a wide variety of alkanolamines, as well as calcium hydroxide, magnesium hydroxide, calcium carbonate, sodium and potassium hydroxides may be used.

The method of making the composition according to the present invention comprises the steps of (1) combining one equivalent of diethylene triamine or dipropylene triamine with two equivalents of fatty acid to yield an $\alpha$, $\omega$ bis-amidoamine;

(2) carboxylating the $\alpha,\omega$ bis-amidoamine with maleic anhydride acrylic acid, phthalic anhydride, or methyl maleic anhydride;

(3) neutralizing the above carboxylated product to form a salt; and (4) adding the above salt to an aqueous solution.

The combination of the diethylene triamine or dipropylene triamine with the fatty acid may be accomplished at a temperature of 120°–150° C. and standard pressure in 2–5 hours.

The carboxylation step may be run to completion at a temperature of 100° C. At standard pressure, the reaction time is approximately one hour. Finally, neutralization may be completed at 70°-100° C. and standard pressure.

The present invention also includes the method of using the above composition by applying it to metal surfaces where lubrication and/or corrosion inhibition are desired properties.

The composition described herein is particularly effective as a lubricant and corrosion inhibitor for metal-cutting and forming metalworking processes. Indeed, the present invention would have application wherever properties of metal lubrication and corrosion inhibition are required. The present invention is effective with any type of metal, particularly ferrous metals and most particularly, steel.

DETAILED DESCRIPTION OF THE PREFERRED EMBODIMENT

The present invention is a combined corrosion inhibiting and lubricating composition for use with ferrous metal surfaces comprising an aqueous fluid containing an effective amount of a fatty acid substituted, carboxylated bis-amidoamine of the following formulae (I, II):

(I)

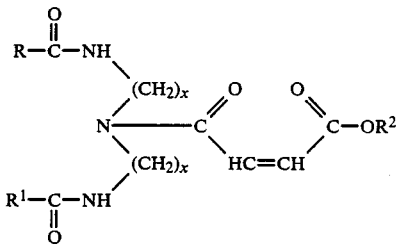

(II)

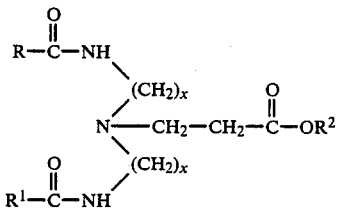

wherein R and $R^1$ are aliphatic chains of from 14 to 20 carbons, x is an integer from 2 to 3, and $R^2$ is a hydrogen, an alkanolamine, or an inorganic base. Among the suitable alkanolamines, are those of the formula:

$$N-(R^3)_3$$

wherein $R^3$ is an aliphatic alcohol radical, of 2 to 6 carbons, including ethanol. Among the suitable inorganic bases are sodium, potassium and calcium carbonate, which generate sodium, potassium and calcium cations.

The anti-corrosion, lubricating compositions of the present invention all employ as a starting material two equivalents of fatty acids which react with one equivalent diethylene triamine or propylene triamine to produce an $\alpha,\omega$ bis-amidoamine of the following formula (III):

(III)

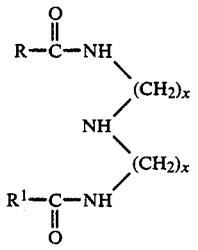

wherein and R and $R^1$ are aliphatic chains of from 14 to 20 carbons, and x is an integer from 2 to 3. The aliphatic chains are the residue of the fatty acid reactants having 15 carbon to 21 carbon atoms.

The fatty acids are preferably oleic acid, linoleic acid, palmitic acid, palmitoleic acid, stearic acid and mixtures thereof. Examples of ranges suitable for use are: oleic acid 40-60 wt.%, linoleic acid 40-50 wt.%, stearic acid 0.5-3.0 wt.%, palmitic acid 0.1-2.0 wt.% and palmitoleic acid 0.1-2.0 wt.%. A preferred mixture of fatty acids having the following composition—oleic acid 50.5%, linoleic acid 46.5%, stearic acid 1.5%, palmitic acid 1% and palmitoleic acid 0.5%—is commercially available from Westvaco Corp. under the product designations L-1 or L-5.

The above fatty acid formulations, when employed in the present invention, will yield an additive which is water dispersible and is suitable for use in soluble oil and semi-synthetic systems. "Soluble oils" are defined as a clear concentrate containing 30% to 90% oil and forming an opaque fluid when diluted 20:1 with water. "Semi-synthetic system" is defined as a clear concentrate containing 0-30% oil and forming a clear or translucent fluid when diluted 20:1 with water. Where a water soluble additive is used in a synthetic system, Westvaco Diacid ®1550, another Westvaco Corp. fatty acid formulation, may be substituted for the part of the L-1 or L-5 formulations. As used herein, a "synthetic system" is defined as containing no oil. The Westvaco Diacid ®1550 composition comprises 21 carbon dicarboxyl fatty acids. Generally, in a synthetic system, from 10% to 60% by weight Westvaco Diacid ®1550 may be employed, with from about 30% to 50% by weight being preferred.

The above bis-amidoamine (III) is reacted with maleic anhydride to yield (IV)

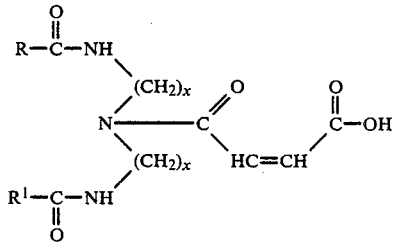

or with acrylic acid to yield

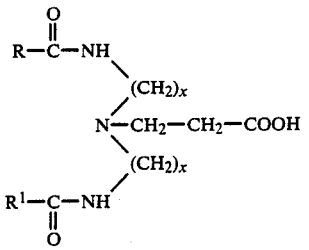

(V)

wherein, R, $R^1$ and x are defined as above. The above substituted maleamic acid (IV) or substituted acrylamic acid (V) is then neutralized with an organic or inorganic basic material. Alkanolamines, such as triethanolamine, triisopropanolamine, diethananolamine, diisopropanolamine, ethanolamine, isopropanolamine, and their total or partial mixture are examples of the organic neutralizing agents which may be used. Non-organic salts, such as calcium hydroxide, magnesium hydroxide, calcium carbonate, sodium hydroxide and potassium hydroxide, may also be used. Triethanolamine is the most preferred neutralizing agent used. To assure complete neutralization it is necessary to add at least one equivalent, and preferably two equivalents, of neutralizing agent for each fatty acid equivalent.

Either of the resulting salts or a mixture of the two is then added to an aqueous solution to yield a metalworking fluid generally comprising from about 0.5% to 5.0% by weight of the solution. The preferred concentration ranges from about 1.0% by weight to about 3% by weight of the solution. The most preferred concentration is about 2.0% by weight.

The practice of this invention may be more clearly understood from the following non-limiting illustrative examples. All amounts shown are by weight.

EXAMPLE 1

(L-5 Formulation)

A carboxylated amine fatty acid condensate was prepared using 2 moles of Westvaco® L-5 (a fatty acid composition) and combined with 1 mole of diethylene triamine at 120°–150° C. for 2–5 hours to form a condensate. The resulting bis-amidoamine was allowed to cool to 100° C. and was then carboxylated with 1 mole of maleic anhydride to yield a substituted maleamic acid. Finally, the substituted maleamic acid was neutralized with triethanolamine.

EXAMPLE 2

(Diacid 1525 Formulation)

A carboxylated amine fatty acid condensate was prepared using two moles of Diacid 1525 and combined with diethylene triamine at 120°–150° for 2–5 hours to form a condensate. The resulting bis-amidoamine was then allowed to cool to 100° C. and carboxylated with 1 mole of acrylic acid to yield a substituted acryleamic acid. Finally, the substituted acryleamic acid was neutralized with triethanolamine.

EXAMPLE 3

(Diacid 1550 Formulation)

A corrosion-inhibiting composition made in accordance with Example 1 was prepared, except that Diacid 1550 fatty acid was partially substituted for the L-5. When added to water a clear solution was obtained.

EXAMPLE 4

(L-1 Formulation)

A corrosion-inhibiting lubricant like that of Example 1 was prepared, except that the fatty acid component was Westvaco® L-1.

EXAMPLE 5

(Comparison Corrosion Test)

To demonstrate the corrosion inhibiting effectiveness of the present invention, tests were conducted using various conventional additives and the additives of the present invention using the chip test procedure. The chip test procedure is an overnight test of the fluid wetted cast iron chips on filter paper in 85 to 100% humidity in order that the chips stay wet throughout the test. The purpose of these tests was to determine the lowest concentration of rust inhibitor formulation at which no rust stain would appear. The results of such tests are shown in TABLE I.

Conventional rust inhibiting additives tested were: Synkad 500, a dicarboxylate salt commercially available from the Keil Division of Ferro Corp., Aqualox 232, a commercial corrosion inhibitor commercially available from Alox Corporation located in Niagara Falls, N.Y., and sodium nitrite. Conventional lubricants tested were azelaic acid (a reaction product of an organic polycarboxylic acid and a polyoxyalkylene diamine which is converted to a salt by the addition of a base), as is more fully described in U.S. Pat. No. 4,239,635, and Inversol 140, a water soluble water lubricant and available from Keil Division of Ferro Corp.

The corrosion inhibition properties of aqueous formulations using the compositions prepared in accordance with Examples 1–4 were measured. All Example compositions were formulated into trial fluids of 5% additive, 10% triethanolamine and 85% de-ionized water. These fluids were diluted with 100 ppm calcium chloride water to produce the final additive concentration. The results which appear in TABLE I demonstrate the rust inhibiting ability of the formulations of the present invention against conventional additives.

EXAMPLE 6

(Comparison Lubrication Test)

A Falex Failure Load test was also conducted to measure the lubricating ability of additives of Examples 1–4 against conventional lubricants, such as Synkad 500, azelaic acid, described above, and Inversol 140. Sodium nitrite was not evaluated since it would not be expected to have any lubricating properties. The Examples 1–4 compositions were mixed with triethanolamine in a 1:2 weight ratio and diluted with water to yield a 0.25% concentration. The conventional lubricants were used in the same concentration with triethanolamine in the same concentration. The Falex Failure Load Test is a three-minute break-in followed by a run-up on #10 pins. The purpose of the test was to measure the load at which there would be failure. The results, shown in TABLE I, illustrate the superior lubricating ability of the compositions of the present invention.

EXAMPLE 7

(Comparison Foam Test)

Foam volume was measured using the compositions of Examples 1 and 2 mixed with triethanolamine in a 1:2 weight ratio and diluted with water to yield a 1% concentration. The conventional azelaic acid formulation and Synkad 500 were also tested with the results shown in TABLE I. As can be seen, the formulations of the present invention do not generate excessive foaming either initially ($t_0$) or after five minutes ($t_5$).

TABLE I

| | Rust Free Point | Falex Failure Load (in pounds) | Foam Volume $t_0$ | Foam Volume $t_5$ |
|---|---|---|---|---|
| Example 1 | 0.5% | 3,650 | 200 | 180 |
| Example 2 | 0.5% | 3,650 | 140 | 70 |
| Example 3 | 0.5% | 4,000 | — | — |
| Example 4 | 0.5% | 4,000 | — | — |
| Synkad 500 (rust inhibitor) | 0.5% | 500 | 20 | 20 |
| Sodium Nitrite (rust inhibitor) | 0.5% | — | — | — |
| Azelaic Acid Formulation (lubricant) | >2.0% | 3,050 | 200 | 140 |
| Inversol 140 (lubricant) | >2.0% | 4,000 | — | — |
| Aqualox 232 (rust inhibitor) | 0.5% | 500 | — | — |

EXAMPLE 8

(Comparison Lubrication Power Requirement Test)

Various concentrations of the Example 1 composition (mixed with ethanolamine in a 1:1 ratio) were compared with the azelaic acid lubricant in a pipe threading machine. The power requirements of the pipe threading machine were measured with the results shown in TABLE II.

TABLE II

| PIPE THREADING POWER REQUIREMENTS (HP) | | |
|---|---|---|
| % Concentration | Present Invention (Ex. 1) | Azelaic Acid Lubricant |
| 0.0 | 0.87 hp | 0.87 hp |
| 0.05 | 0.84 hp | 0.87 hp |
| 0.25 | 0.82 hp | 0.83 hp |
| 0.5 | 0.80 hp | 0.85 hp |
| 2.0 | 0.77 hp | 0.80 hp |

As will be seen from TABLE II, at all levels of concentration, i.e., from 0.05 to 2%, the additives of the present invention resulted in reduced horsepower requirements over the well-known additive of the prior art.

Based on the foregoing tests, it is clear that the formulations of the present invention offer a combination of improved rust-inhibiting and lubricating properties, with only moderate foaming characteristics.

Althoug a preferred form of the present invention has been illustrated and described, it should be understood that the invention is capable of modification by one skilled in the art without departing from the principles of the invention. Accordingly, the scope of the invention is to be limited only by the claims appended hereto.

What is claimed is:

1. An improved aqueous metalworking fluid system selected from the group consisting of synthetic and semi-synthetic systems wherein the improvement comprises an additive providing both corrosion inhibition and lubrication selected from the group consisting of a fatty acid substituted, carboxylated bis-amidoamine and salts thereof.

2. The composition of claim 1 wherein the formula of the fatty acid substituted, carboxylated bis-amidoamine is

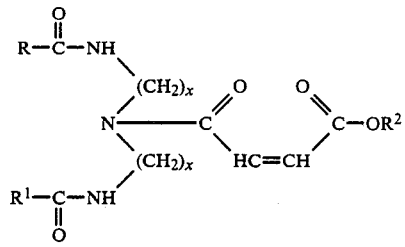

(I)

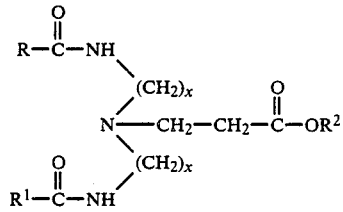

(II)

wherein R and $R^1$ are aliphatic chains of from 14 to 20 carbon atoms, $R^2$ is a hydrogen, an alkanolamine or an inorganic cation, and x is an integer from 2 to 3.

3. The composition of claim 2 comprising an aqueous formulation of said fatty acid substituted, carboxylated bis-amidoamine, said metal surfaces comprising ferrous metal.

4. The composition of claim 3 wherein the fatty acid substituted, carboxylated bis-amidoamine comprises from about 0.50 wt. % to about 5.0 wt. % of the formulation.

5. The composition of claim 3 wherein the fatty acid substituted, carboxylated bis-amidoamine comprises from about 1.0 wt. % to about 3.0 wt. % of the formulation.

6. The composition of claim 4 wherein R and $R^1$ are derived from the group consisting of oleic, linoleic, palmitic, palmitoleic and stearic acids or mixtures thereof.

7. The composition of claim 6 wherein said fatty acid comprises 40–60 wt.% oleic acid, 40–50 wt.% linoleic acid, 0.5–3.0 wt.% stearic acid, 0.1–2.0 wt.% palmitic acid and 0.1–2.0 wt.% palmitoleic acid.

8. The composition of claim 6 wherein said fatty acid comprises approximately 50.5 wt.% of said oleic acids, 46.5 wt.% linoleic acid, 1.5 wt.% stearic acid, 1 wt.% palmitic acid and 0.5 wt.% palmitoleic acid.

9. The composition of claim 3 wherein at least 25 wt.% of the fatty acid content comprises 21 carbon dicarboxyl fatty acids.

10. The composition of claim 3 wherein at least 50 wt.% of the fatty acid content comprises 21 carbon dicarboxyl fatty acids.

11. The composition of claims 3 wherein $R^2$ is an alkanolamine of the following formula:

$$N—(R^3)_3$$

wherein $R^3$ is an aliphatic alcohol radical of 2 to 6 carbons.

12. The composition of claim 11 wherein $R^3$ is an ethanol radical.

13. The composition of claim 3 wherein $R^2$ is an inorganic cation.

14. The composition of claim 13 wherein $R^2$ is taken from the group of cations consisting of calcium, sodium, potassium, and magnesium.

15. The composition of claim 3 wherein x is 2.

16. The composition of claim 3 wherein x is 3.

17. The composition of claim 1 wherein the fatty acid substituted, carboxylated bis-amidoamine is:

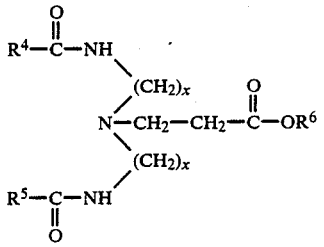

wherein $R^4$ and $R^5$ are aliphatic chains of from 14 to 20 carbon atoms, $R^6$ is a hydrogen, an inorganic cation or an alkanolamine, and x is an integer from 2 to 3.

18. The composition of claim 17 comprising an aqueous formulation.

19. The composition of claim 18 wherein the fatty acid substituted, carboxylated bis-amidoamine comprises from about 0.50 wt.% to about 5.0 wt.% of the formulation.

20. The composition of claim 18 wherein the fatty acid substituted, carboxylated bis-amidoamine comprises from about 1.0 wt. % to about 3.0 wt. % of the formulation.

21. The composition of claim 18 wherein $R^4$ and $R^5$ are derived from a group consisting of oleic, linoleic, palmitic, palmitoleic and stearic acids or mixtures thereof.

22. The composition of claim 18 wherein said fatty acid comprises approximately 50.5 wt. % oleic acids, 46.5 wt. % linoleic acid, 1.5 wt. % stearic acid, 1 wt. % palmitic acid and 0.5 wt. % palmitoleic acid.

23. The composition of claim 18 wherein at least 25 wt. % of the fatty acid comprises a 21 carbon dicarboxyl fatty acid.

24. The composition of claim 18 wherein at least 50 wt. % of the fatty acid comprises a 21 carbon dicarboxyl fatty acid.

25. The composition of claim 17 wherein $R^6$ is an alkanolamine of the following formula:

$$N-(R^7)_3$$

wherein $R^7$ is an alphatic alcohol radical of 2 to 6 carbons.

26. The composition of claim 25 wherein $R^7$ is an ethanol radical.

27. The composition of claim 17 wherein x is 2.

28. The composition of claim 17 wherein x is 3.

29. The composition of claim 17 wherein $R^6$ is an inorganic cation.

30. The composition of claim 29 wherein $R^6$ is taken from the group of cations consisting of calcium, sodium, potassium, and magnesium.

31. The composition of claim 1 wherein the bis-amidoamine has been carboxylated with a phthalic anhydride.

32. The composition of claim 1 wherein the bis-amidoamine has been carboxylated with a methyl maleic anhydride.

33. A process for making a composition for inhibiting corrosion on ferrous metal surfaces and for lubricating said surfaces, comprising the steps of:

combining two parts fatty acid and one part diethylene triamine or dipropylene triamine to form an $\alpha,\omega$ bis-amidoamine;

reacting said $\alpha,\omega$ bis-amidoamine with a carboxylating agent taken from the group consisting of maleic anhydride, acrylic acid, fumaric acid and methacrylic acid to form a carboxylated $\alpha,\omega$ bis-amidoamine; and neutralizing said carboxylated $\alpha$, $\omega$ bis-amidoamine by addition of a base selected from the group consisting of an alkanolamine, calcium carbonate, and compounds of sodium and potassium to form a salt.

34. The process of claim 33 further including the step of diluting to a fatty acid substituted, carboxylated bis-amidoamine concentration of from about 0.50 wt. % to about 5.0 wt. %.

35. The process of claim 33 further including the step of diluting to a fatty acid substituted, carboxylated bis-amidoamine concentration of from about 1.0 wt. % to about 3.0 wt. %.

36. The process of claim 35 wherein said fatty acid is taken from the group consisting of oleic, linoleic, palmitic, palmitoleic and stearic acid or mixtures thereof.

37. The process of claim 36 wherein said fatty acid comprises 40–60 wt.% oleic acid, 40–50 wt.% linoleic acid, 0.5–3.0 wt.% stearic acid, 0.1–2.0 wt.% palmitic acid and 0.1–2.0 wt.% palmitoleic acid.

38. The process of claim 31 wherein fatty acid comprises about 50.5 wt.% oleic acids 46.5 wt.% linoleic acid, 1.5 wt.% stearic acid, 1.0 wt.% palmitic acid and 0.5 wt.% palmitoleic acid.

39. The process of claim 33 wherein at least 25 wt.% of the fatty acid comprises a 21 carbon dicarboxyl fatty acid.

40. The process of claim 33 wherein at least 50 wt.% of the fatty acid comprises a 21 carbon dicarboxyl fatty acid.

41. The process of claim 33 wherein said base is an alkanolamine of the following formula:

$$N-(R^8)_3$$

wherein $R^8$ is aliphatic alcohol radical of 2 to 6 carbons.

42. The process of claim 41 wherein $R^8$ is an ethanol radical.

43. The process of claim 33 wherein the appropriate base is an inorganic cation.

44. The process of claim 43 wherein the inorganic cation is taken from the group of ions consisting of calcium, magnesium, sodium, and potassium.

45. The process of claim 33 wherein said carboxylating agent is acrylic acid.

46. The process of claim 33 wherein said carboxylating agent is maleic anhydride.

47. A method for inhibiting corrosion and for lubricating metal surfaces comprising the step of applying to a metal surface, in an effective amount to inhibit corrosion and to lubricate the metal surfaces an aqueous metalworking fluid system selected from the group consisting of synthetic and semi-synthetic systems comprising an effective corrosion inhibiting and lubricating amount of an additive selected from the group consisting of a fatty acid substituted, carboxylated bis-amidoamine and salts thereof.

48. The method of claim 47 wherein the said composition comprises from about 0.50 wt.% to about 5.0 wt.% of said formulation.

49. The method of claim 47 wherein said composition comprises from about 1.0 wt.% to about 3.0 wt.% of said formulation.

50. The method of claim 47 wherein said composition comprises:

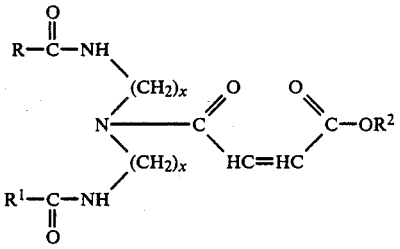

wherein R and $R^1$ are aliphatic chains of from 14 to 20 carbons, $R^2$ is a hydrogen, an alkanolamine or an inorganic cation, and x is an integer from 2 to 3.

51. The method of claim 50 wherein $R^2$ is triethanolamine.

52. The method of claim 51 wherein said fatty acid comprises 40–60 wt.% oleic acid, 40–50 wt.% linoleic acid, 0.5–3.0 wt.% stearic acid, 0.1–2.0 wt.% palmitic acid and 0.1–2.0 wt.% palmitoleic acid.

53. A method of claim 47 wherein said composition comprises:

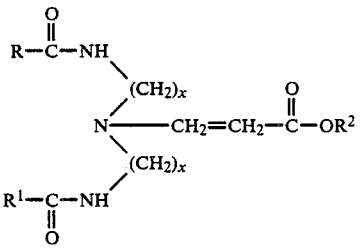

wherein R and $R^1$ are aliphatic chains of from 14 to 20 carbons, and $R^2$ is a hydrogen, an alkanolamine or an inorganic cation, and x is an integer from 2 to 3.

54. The method of claim 53 wherein $R^2$ is triethanolamine.

55. The method of claim 53 wherein R and $R^1$ are derived from one or more of the following fatty acids: oleic acid, linoleic acid, palmitic acid, palmitoleic acid and stearic acid.

56. The method of claim 53 wherein said oleic acid constitutes approximately 40–60 wt.% of said fatty acids, said linoleic acid 40–50 wt.%, stearic acid 0.5–3.0 wt.%, palmitic acid 0.1–2.0 wt.% and palmitoleic acid 0.1–2.0 wt.%.

57. The method of claim 47 wherein at least 25 wt.% of the fatty acid comprises a 21 carbon dicarboxyl fatty acid.

58. The method of claim 47 wherein at least 50 wt.% of the fatty acid comprises a 21 carbon dicarboxyl fatty acid.

59. An aqueous synthetic metalworking fluid composition comprised of water, triethanolamine and from about 0.5% to about 5.0% of an additive selected from the group consisting of a fatty acid substituted, carboxylated bis-amidoamine and salts thereof and is prepared by combining 5% additive, 10% triethanolamine, and 85% de-ionized water and subsequently, for additive concentrations below 5.0%, diluting the composition with 100 ppm calcium chloride water to produce the final additive concentration.

* * * * *

UNITED STATES PATENT AND TRADEMARK OFFICE

CERTIFICATE OF CORRECTION

PATENT NO. : 4,743,388

DATED : May 10, 1988

INVENTOR(S) : Curtis S. Lege

It is certified that error appears in the above-identified patent and that said Letters Patent is hereby corrected as shown below:

In column 4, line 13, delete the first occurrence of "and" and substitute therefor --the--.

In Claim 2, column 8, delete second formula,

"

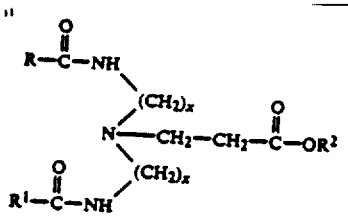

(II)

".

In Claim 11, column 8, line 58, delete "claims" and substitute therefor --claim--.

In Claim 36, column 10, line 24, delete "35" and substitute therefor --33--.

UNITED STATES PATENT AND TRADEMARK OFFICE

CERTIFICATE OF CORRECTION

PATENT NO. : 4,743,388

DATED : May 10, 1988

INVENTOR(S) : Curtis S. Lege

It is certified that error appears in the above-identified patent and that said Letters Patent is hereby corrected as shown below:

In Claim 38, column 10, line 31, delete "31" and substitute therefor --37--.

In Claim 53, column 12, in the formula, delete "$CH_2=CH_2$" and substitute therefor --$CH_2-CH_2$--.

In Claim 56, column 12, line 22, delete "53" and substitute therefor --55--.

Signed and Sealed this

Sixteenth Day of November, 1993

*Attest:*

Bruce Lehman

BRUCE LEHMAN

*Attesting Officer*

*Commissioner of Patents and Trademarks*